US008525755B2

(12) United States Patent
Bezal et al.

(10) Patent No.: US 8,525,755 B2
(45) Date of Patent: Sep. 3, 2013

(54) METHOD AND DEVICE FOR CONTROLLING A MATRIX PLASMA DISPLAY SCREEN

(75) Inventors: Jean-Raphaël Bezal, Grenoble (FR); Jean-Marie Permezel, Grenoble (FR); Gilles Troussel, Grenoble (FR)

(73) Assignee: STMicroelectronics SA, Montrouge (FR)

( * ) Notice: Subject to any disclaimer, the term of this patent is extended or adjusted under 35 U.S.C. 154(b) by 891 days.

(21) Appl. No.: 11/624,989

(22) Filed: Jan. 19, 2007

(65) Prior Publication Data

US 2007/0183183 A1 Aug. 9, 2007

(30) Foreign Application Priority Data

Jan. 20, 2006 (FR) ..... 06 00556

(51) Int. Cl.
*G09G 3/28* (2013.01)

(52) U.S. Cl.
USPC ..... 345/60; 345/63; 345/68

(58) Field of Classification Search
USPC ..... 345/60, 63, 68
See application file for complete search history.

(56) References Cited

U.S. PATENT DOCUMENTS 4,633,139 A * 12/1986 Endo et al. ..... 315/169.4
5,446,344 A * 8/1995 Kanazawa ..... 315/169.3
5,818,776 A * 10/1998 Shibutani et al. ..... 365/221
5,909,199 A * 6/1999 Miyazaki et al. ..... 345/60
7,323,923 B2 * 1/2008 Maeda et al. ..... 327/333
7,486,257 B2 * 2/2009 Kim et al. ..... 345/60
2003/0107327 A1 * 6/2003 Mas et al. ..... 315/169.3
2005/0242870 A1 * 11/2005 Aota ..... 327/541

FOREIGN PATENT DOCUMENTS

WO WO0215163 2/2002
WO WO02/41292 5/2002

OTHER PUBLICATIONS

"The Art of Electronics", Paul horowitz, 1989, Cambridge University Press, XP002400356, p. 72.

* cited by examiner

*Primary Examiner* — Kwang-Su Yang
(74) *Attorney, Agent, or Firm* — Allen, Dyer, Doppelt, Milbrath & Gilchrist, P.A.

(57) ABSTRACT

A control device for a matrix plasma display screen has a row driver circuit capable of sequentially selecting the rows of the matrix and a column driver circuit, for each column of the matrix, with an individual column driver unit that has at least a first transistor of the MOS type capable of emitting, towards each column of a desired set of columns, a state change signal in order to allow the transition of the set from a first state towards a second state, and a controller. The first transistor is capable of emitting state change signals that have a state that is transitional from a low state towards a high state; the controller has a control transistor with one electrode directly connected to the power supply terminal and another electrode capable of delivering a control voltage to the control electrode of the first transistor, so as to limit the value of the current flowing through the first transistor in the course of the transitional state, in such a manner as to regulate the rise time of the state change signal.

22 Claims, 6 Drawing Sheets

METHOD AND DEVICE FOR CONTROLLING A MATRIX PLASMA DISPLAY SCREEN

FIELD OF THE INVENTION

The invention relates to plasma display screens and, more particularly, to the control of the cells of such a screen.

BACKGROUND OF THE INVENTION

A plasma display screen is a display screen of the matrix type, formed from cells disposed at the intersections of rows and columns. A cell comprises a cavity, filled with a noble gas, and at least two control electrodes. In order to create a light point on the screen using a given cell, the cell is selected by applying a potential difference between these control electrodes, then ionization of the gas in the cell is triggered generally by means of a third control electrode. This ionization is accompanied by an emission of ultraviolet rays. The creation of the light point is obtained by excitation of a red, green and blue light-emitting material, by the emitted radiation. Conventionally, the control of a plasma display screen essentially comprises two phases, namely an addressing phase in which the cells (pixels) that will need to be lit and those that will need to be extinguished are determined, together with a display phase proper in which the cells having been selected in the addressing phase are effectively lit.

The addressing phase comprises a sequential selection of the rows of the matrix. By way of example, the rows not selected are set at a standby potential, for example 150 volts, whereas a selected row is set at an activation potential, for example 0 volts. In order to select chosen pixels from the selected row, pixels that will need to be lit in the display phase, the corresponding columns of the matrix are, for example, raised to a relatively high potential, for example 70 volts, by means of a power stage comprising MOS power transistors. The columns corresponding to the other pixels of the selected row, which will not need to be lit, are set at the potential 0 volts. Thus, the cells of the activated row, which will need to be lit, see a column-row potential equal to around 70 volts, whereas the other cells of this row see a column-row potential equal to 0 volts.

However, it may also be envisioned in the addressing phase, with the application of different potentials to the rows of the matrix, that a high potential be applied to a column in order to select a pixel that will need to be extinguished, and to apply a low potential to a column in order to select a pixel that will need to be lit.

The International Patent Application WO 02/15 163 gives an example of the general operation of such a plasma display screen, and focuses in particular on the problem of the selection of the columns when a row has been selected. More precisely, this document of the prior art states and solves the problem of the current spike flowing through the power transistors connected to the selected row, when a very large number of columns are simultaneously selected (corresponding to a very large number of pixels that are to be lit).

Aside from the problem of the current spike flowing through the power transistors when a very large number of columns are simultaneously selected, the inventors have identified another problem in the control of the cells of a plasma display screen, more particularly when the control is affected with a signal comprising a transition from a low potential to a high potential.

More precisely, the case can be taken where all the pixels of the row i must be in a given first state, for example lit (or extinguished, depending on the chosen convention) and all the pixels of the following row i+1 must be in the other state, for example extinguished (or lit, depending on the convention envisaged). In this case, in the addressing phase, when the row i is selected, all the columns of the display receive a command to change state, in other words their potential will be raised to a high state (to 70 volts for example), by following a rising edge over a given time. Subsequently, when the next row, i+1, is activated, the potential on the columns must be made to fall back to a low state (0 volts for example).

The transition from one state to another is carried out by applying a logic signal to a driver module situated on each of the columns in such a manner that one of the power transistors of the driver module is turned on in order to allow the capacitance of the cell in question to charge up or to discharge (depending on the convention considered). It has been observed that when a very large number of columns go from a low potential to a high potential, for example at least two thirds of the display columns, the rising edges of the respective column voltages are especially steep, in other words the rise time is around 40 nanoseconds. This leads to an emission of additional electromagnetic interference that can affect the operation of other components situated in close proximity.

Furthermore, the value of the selection current may vary from one circuit to another depending on the value of the load connected to the selection circuit. In particular, when the value of the load is relatively low, the selection current can take a very high value resulting in a strong over-voltage spike within the voltage source supplying the high potential (here 70 volts) for activation of the display column driver circuit.

The International Patent Application WO 02/41 292, assigned to the present applicant, proposes a solution where the column driver circuit comprises a current source so as to control the voltage applied to the gate of the power transistor delivering the selection signal. The control will be effective during the entire rise time of the transition signal from its low value to its high value. The rise time of the selection signal is therefore fixed and constant, and the value of current, delivered by the controlled power transistor, will be limited over the whole transition.

However, the integration of a current source into the column driver circuit represents a high cost in terms of the silicon surface area required to fabricate the circuit. In addition, the steep edge of the selection signal is attenuated by the control affected by the current source but on the contrary, at the end of the transition, the latter is steeper than it was, which generates high-frequency signals that promote electromagnetic emissions. Furthermore, the current source is sensitive to the variations in the driver circuit power supply voltage, which interferes with the control effected on the gate of the power transistor. This method aims to provide a solution to these problems.

SUMMARY OF THE INVENTION

One object of the invention is to limit, in a very simple manner, the electromagnetic emissions associated with the steepness of the rising edges of the column selection (or deselection) signals, and the resulting current spikes, whatever the load seen by the circuit, and without significantly increasing the silicon surface area required for the fabrication of the circuit. Another object of the invention is to decrease the sensitivity of the circuit to the variations in the power supply voltage, associated with the use of a current source. Another object of the invention is to promote the reduction of the electromagnetic emissions associated with the steepness of the transition when the state change signal reaches its high value.

Thus, according to one aspect, a method is provided for controlling a matrix plasma display screen comprising a sequential selection of rows of the matrix and, for a selected row, the emission of a state change signal towards each column of a desired set of columns, by means of a first transistor of the MOS type, in order to allow the transition of each column of the set from a first state towards a second state.

According to a general feature of this aspect, each state change signal comprises a state that is transitional from a low state towards a high state. Furthermore, the rise time of the state change signal is regulated, by limiting the value of the current flowing through the first transistor in the course of the transitional state, by the control of the value of the voltage delivered to the control electrode of the first transistor by means of a control transistor. In other words, the rise time of the state change signal is regulated by controlling the current flowing in the transistor delivering the state change signal, only during the transition from the low state towards the high state and, more particularly, at the start of this transition.

Furthermore, due to the value of the voltage delivered to the control electrode of the first transistor being controlled, the transition from a low state towards a high state of the state change signal comprises a progressive increase in the value of the signal following a given ramp. The control effected has the advantage of imposing a minimum rise time whatever the value of the load connected to the control device, while at the same time ensuring a softer end of transition of the state change signal, given that the value of the current flowing through the first transistor is only limited at the start of the transition.

The value of the current flowing through the first transistor may be limited only during the transitional state. For example, the value of the current flowing through the said first transistor can be limited as long as the value of the control voltage of the first transistor is below a threshold that is a function of the characteristics of the control transistor. The rise time of the state change signal may be within an interval extending from 70 nanoseconds to 150 nanoseconds. In other words, the ramp of the state change signal is determined so that the latter is effected within the aforementioned interval.

According to another aspect, a control device for a matrix plasma display screen is provided and comprising a row driver circuit capable of sequentially selecting the rows of the matrix and a column driver circuit comprising, for each column of the matrix, an individual column driver unit, comprising at least a first transistor of the MOS type, capable of emitting towards each column of a desired set of columns, a state change signal allowing the transition of the set from a first state towards a second state, and a control means or a controller.

According to a general feature of this aspect, the first transistor is capable of emitting the state change signals which comprise a state that is transitional from a low state towards a high state, the control means comprising a control transistor comprising one electrode directly connected to the power supply terminal and another electrode capable of delivering a control voltage to the control electrode of the first transistor, so as to limit the value of the current flowing through the first transistor in the course of the transitional state, in such a manner as to regulate the rise time of the state change signal.

This circuit has the advantage of being particularly simple to fabricate since only the sizing of the control transistor allows the limitation of the current flowing in the first transistor delivering the state change signal. By using the parameters of the control transistor, the limitation of the current flowing through the first MOS transistor is only effective at the start, then is attenuated owing to the change in operating region of the control transistor when the state change signal reaches a certain value. The rise time of the state change signal may be within an interval extending from 70 ns to 150 ns.

According to one embodiment, the control transistor comprises:

- a control electrode capable of receiving the state change signal, and
- a first electrode that is connected to the control electrode of the first transistor and is capable of delivering a control voltage having a transition from a low state towards a high state with a rise time equivalent to the rise time of the state change signal.

According to one embodiment, the control means further comprises a control resistor, connected between the power supply terminal and a second electrode of the control transistor, whose value is determined as a function of the rise time of the state change signal. Thus, by using a control resistor having a chosen value, a control transistor whose dimensional parameters are coarser can be used and, for example, the duration of the limitation of the current flowing through the first transistor can be adjusted simply by means of the control resistor.

For example, the control resistor can have a value of the order of a few tens of kΩ. Preferably, the control means may also comprises a second transistor connected between the first transistor and ground. According to another aspect, the invention also provides a plasma display comprising a matrix plasma display screen and a control device such as that described hereinabove.

BRIEF DESCRIPTION OF THE DRAWINGS

Other advantages and features of the invention will become apparent upon examining the detailed description of embodiments and their implementation, which are in no way limiting, and the appended drawings in which.

DETAILED DESCRIPTION OF THE PREFERRED EMBODIMENTS

Figure 1:
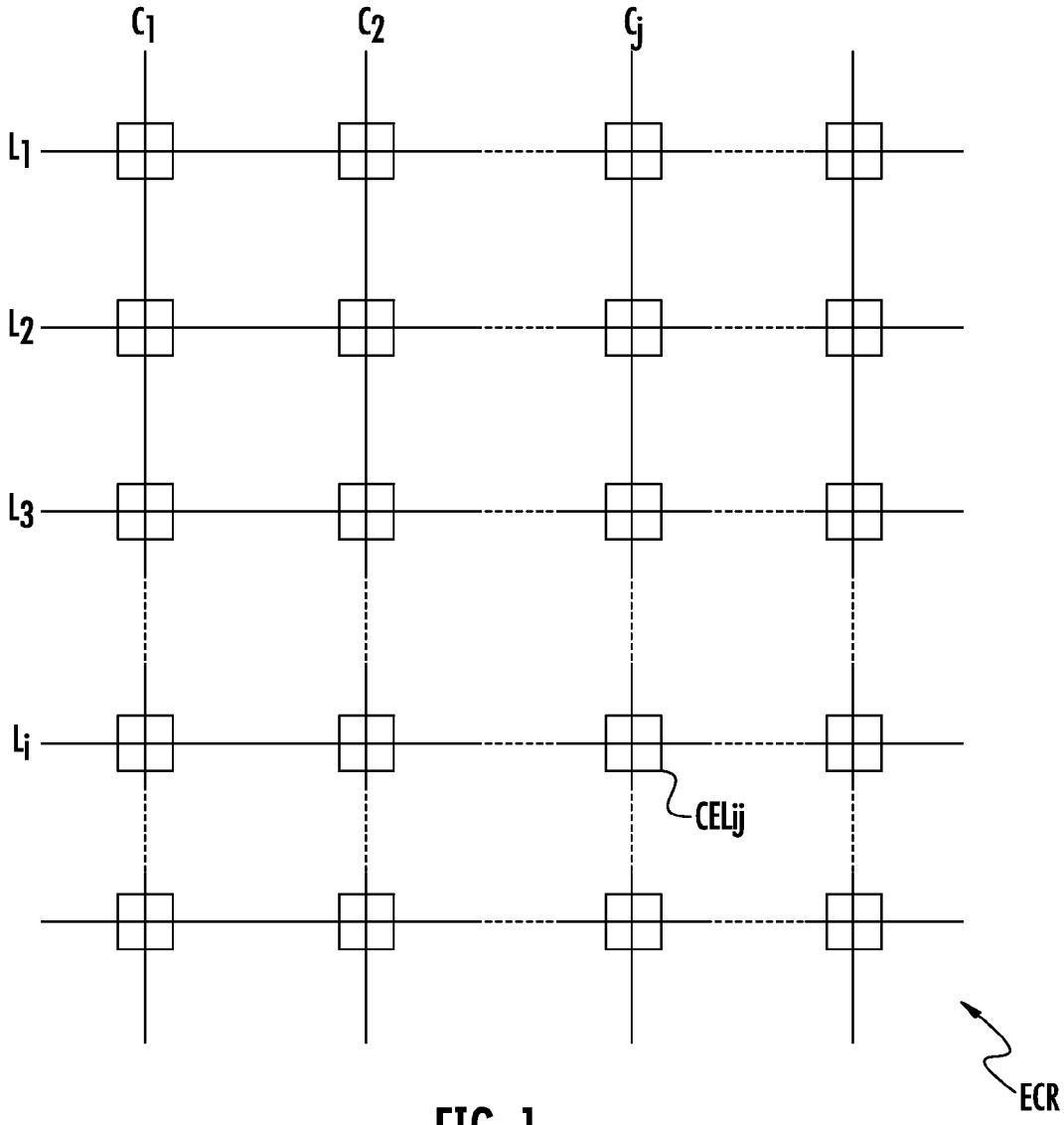
FIG. 1 is a schematic illustration of a matrix display screen according to one embodiment of the invention, FIG. 2 describes one embodiment of the method according to the invention.

FIG. 1 shows schematically a structure of a matrix plasma display screen ECR formed from cells CELij (corresponding to image pixels). Each cell CELij has two control electrodes connected, respectively, to a row Li and to a column Cj. Each cell has an equivalent capacitance of the order of several tens of picofarads. The device controlling this display comprises a row driver circuit capable of sequentially selecting the rows of the matrix, and a column driver circuit capable of selecting or deselecting, as the case may be, several previously selected columns. These circuits are generally integrated onto a semiconductor microchip.

Figure 2:
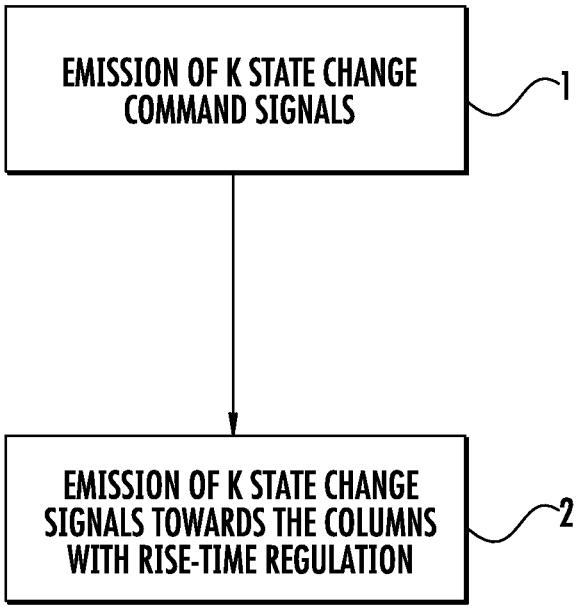

Conventionally, when a column has been selected, its potential is raised to a high value Vpp, typically of the order of 70 volts (in order to light or to extinguish a pixel depending on the mode of operation chosen for the display). As described in FIG. 2, when k columns need to be selected (in order to extinguish or to light k pixels depending on the mode of operation chosen for the display), the voltage of each column has to be raised from the value zero to the value Vpp, for example. For this purpose, k state change signals are emitted in a first step causing, during a second step, the simultaneous emission of the k selection signals for the k columns, while at the same time regulating the rise time of each of these signals.

Figure 3:
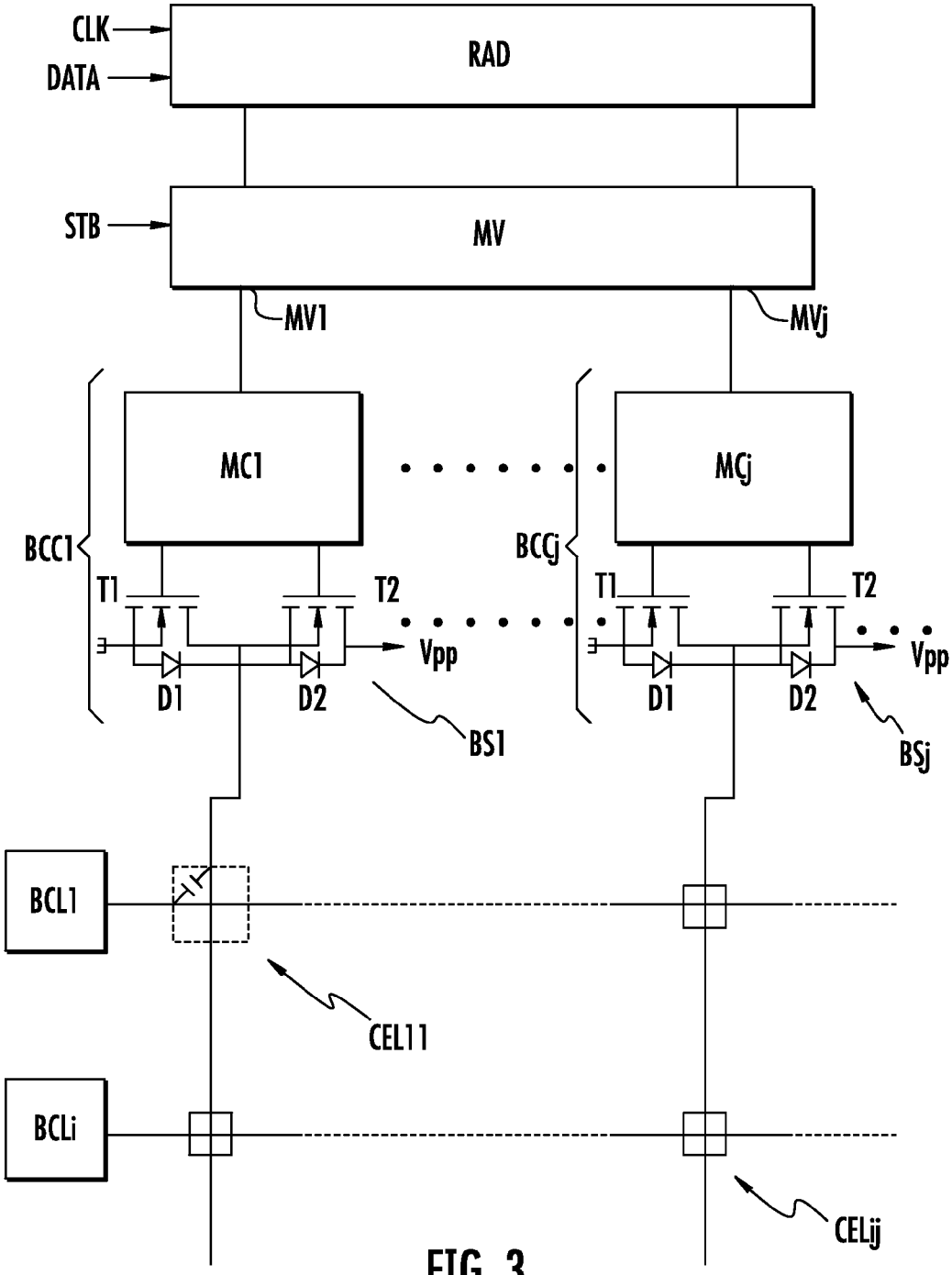
FIG. 3 is a detailed representation of one embodiment of a control device according to the invention.

FIG. 3 illustrates schematically one embodiment of a control device allowing the method to be implemented. The row driver circuit here comprises individual row driver units BCL1-BCLj, of conventional structure and known per se, respectively connected to the rows of the display matrix. The column driver circuits comprise individual driver units BCC1-BCCj, respectively connected to the columns C1-Cj of the display.

The column driver circuit also comprises, upstream of these individual driver units, a shift-register RAD, timed by a clock signal CLK and receiving the binary data referenced DATA, and intended notably for deselecting, if required, columns which have previously been selected during the selection of the preceding row. The outputs of the shift-register RAD are connected to the inputs of a latch MV whose respective outputs are connected to the inputs of the individual driver units BCC1-BCCj. The latch MV is controlled by an activation signal STB which will deliver, at these outputs, MV1-MVj the data present at the input of the latch MV. Each individual driver unit BCCj comprises a control means or a controller MCj whose structure will be described in more detail hereinbelow.

The output of the unit MCj is connected to a power stage BSj here formed from two MOS transistors, T1 and T2, which are n-MOS in this case. In this example, the transistor T1 can deliver a column deselection signal, whereas the transistor T2 can deliver a selection signal for the same column. The column selection signals may be emitted simultaneously or otherwise.

The gates of each transistor are respectively connected to two outputs of the control means MCj. Furthermore, the source of the transistor T1 is connected to ground, whereas the drain of the transistor T2 is connected to the voltage Vpp. The source of the transistor T2 and the drain of the transistor T1 are connected together.

In addition, the power stage BSj comprises two diodes D1 and D2 respectively connected between the source and the drain of T1, on the one hand, and between the source and the drain of T2, on the other. The two diodes D1 and D2 are protection diodes for the two transistors T1 and T2, which are well known to those skilled in the art. The common node between the two transistors T1 and T2 is connected to each corresponding column.

Figure 4:
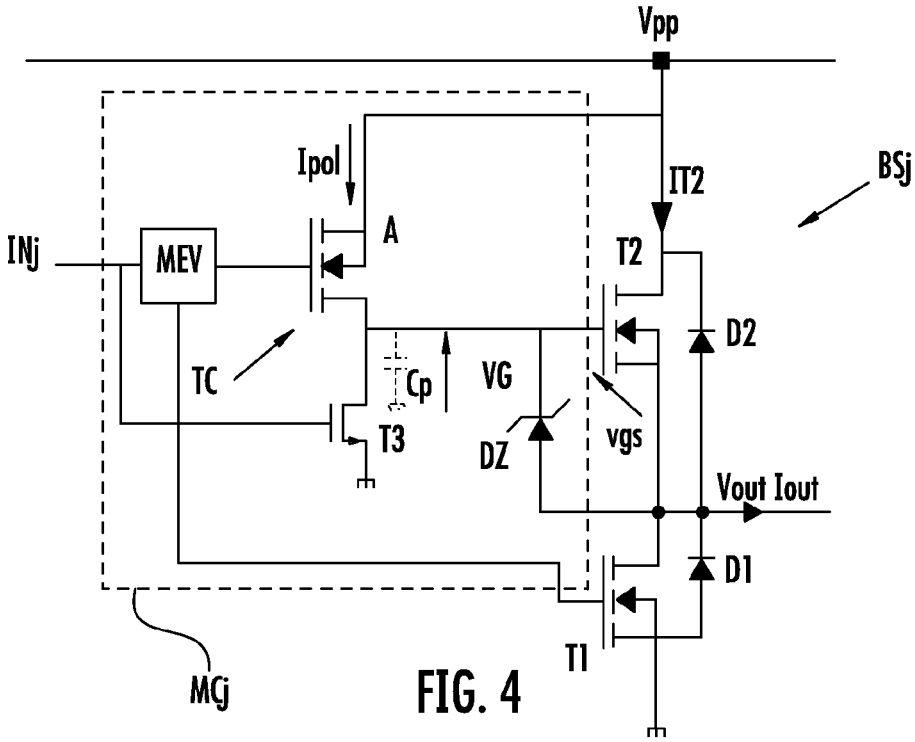
FIG. 4 illustrates more precisely one embodiment of a control means according to the invention.

Reference is now made to FIG. 4 which describes a first embodiment of a control means MCj. The control means receives at its input a state change command signal INj coming from an output MVj of the latch MV. The signal is in the low or high state depending on whether the column Cj is selected or not. For example, INj is equal to 0 volts in the low state and 5 volts in the high state.

The signal INj is delivered to a means or transformer MEV which forms a voltage step-up circuit, so that the voltage of the signal INj is raised to the value Vpp. The means MEV is connected to the gate of a control transistor TC whose source is connected to the voltage Vpp and drain to the gate of the transistor T2 of the power stage BSj. The control transistor TC is chosen so as to be able to withstand high voltages between its gate and source electrodes. For example, it is particularly advantageous to employ a Thick Gate Oxide transistor or TGO, of the p-MOS type in this case. By way of example, the control transistor may have a gate oxide layer with a thickness greater than 0.5 μm. As a variant, those skilled in the art will know how to adapt the conductivity types of the transistors T1, T2 and TC.

The control means also comprises a capacitor Cp connected between the drain of the control transistor TC and ground. The capacitor Cp represents all of the stray capacitances present in the circuit. The value of the capacitance Cp notably comprises the values of the gate capacitance of T2, of the capacitances of the transistor TC, together with those of the diodes present in the circuit. A zener diode DZ is also connected between the gate of the transistor T2 and its source in such a manner as to protect the gate of the transistor T2 from any possible over-voltages that could occur.

When the state change command signal INj goes from the low state to the high state, in this example indicating the selection of the column Cj, a biasing current Ipol flows in the control transistor TC. The current Ipol charges up the capacitor Cp, and a ramp voltage $V_G$ develops across its terminals. Consequently, the voltage $v_{gs}$ between the gate and the source of the transistor T2, which is a function of the ramp voltage $V_G$, allows the transistor T2 to be turned on. A current $I_{T2}$ then flows through the transistor T2. An output current Iout is generated towards the column Cj and the state change voltage signal Vout goes progressively from the low state to the high state, following the time behavior of the ramp voltage, $V_G$, which therefore controls the gate of T2.

The unit BSj also comprises an MOS transistor T3 connected between the gate of T2 and ground and controlled on its gate by the signal INj. The transistor T3 has the function of fixing the potential on the gate of T2, when the circuit becomes deselected, which prevents the gate from adopting a high-impedance state.

Figure 5:
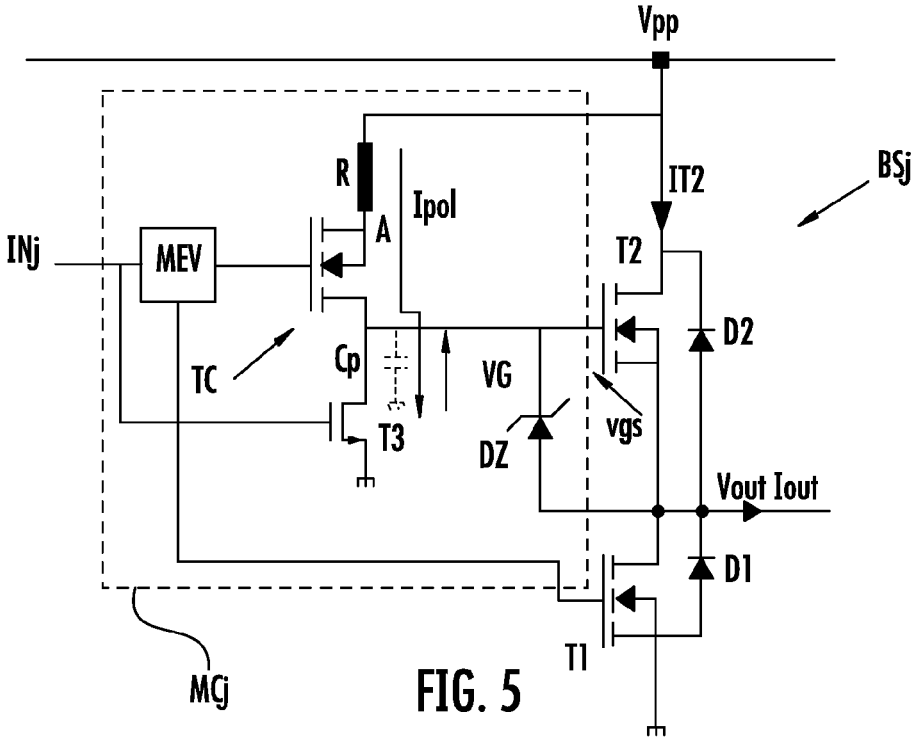
FIG. 5 illustrates one variant of a control means according to the invention.

FIG. 5 shows one embodiment of the control means MCj which is analogous to the embodiment previously described but additionally integrating a resistor R, for example of the order of ten kΩ, between the terminal delivering the voltage Vpp and the source of the transistor TC. The use of a resistor R allows coarser dimensional parameters of the control transistor. The choice of parameters of the control transistor TC in the embodiment in FIG. 4, and the choice of the value of the resistor in the embodiment in FIG. 5 are two means that are simple to implement for limiting the biasing current Ipol which will charge up the capacitor Cp. Its progressive charging will allow the value of the output voltage Vout to increase gradually, and also the output current Iout to be limited.

Figure 6:
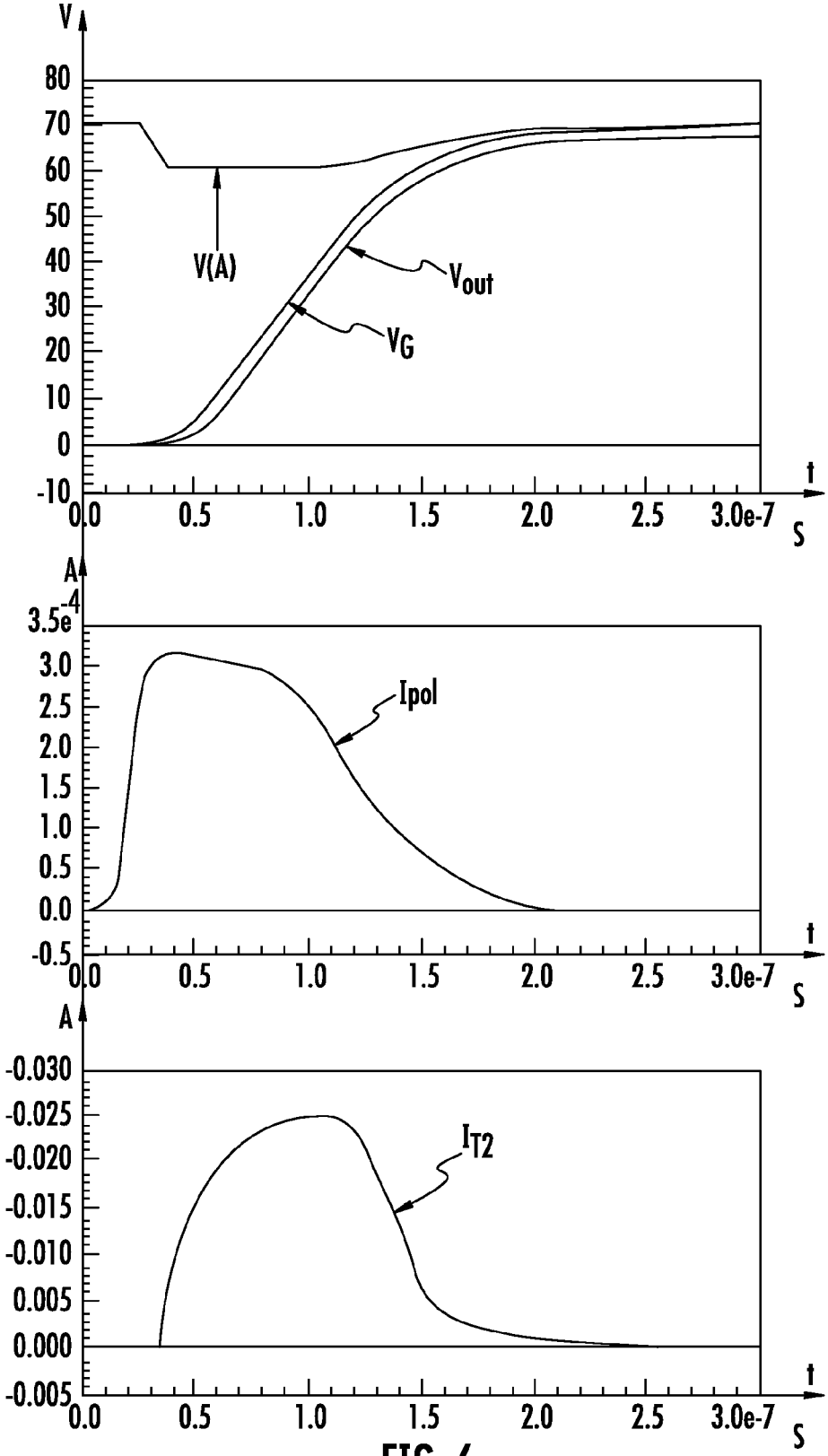
FIG. 6 illustrates the variation of the signals implemented by a control means according to the invention.

FIG. 6 shows the variation of the current Ipol, of the voltage at the point A, of the output voltage and of the current $I_{T2}$ in the embodiment comprising a resistor R. FIG. 6 shows, first of all, the variation of the voltage at the point A, in other words at the source of the transistor TC. Owing to the value of the resistor R, this voltage decreases slightly at the beginning of the change of state in such a manner as to fix the value of $v_{gs}$ of the transistor TC so as to deliver the adapted current Ipol.

As far as the voltage Vout is concerned, it increases gradually between a low state, here 0 volts, as far as the high state, here 70 volts. It has the same behavior profile as the control voltage on the gate of the transistor T2 VG, corresponding to the charge of the capacitance Cp. The voltage ramp Vout is therefore a function of the value of the stray capacitance Cp and of the charging current Ipol, which depends on the characteristics of the control transistor TC and/or, where relevant, on the resistor R.

FIG. 6 also shows the variation of the current Ipol. The control transistor TC has a drain-source voltage which places it in the saturation region of operation. Accordingly, the transistor TC allows a saturation current to flow with a value here of 300 microamps. Then, the increase of the voltage on the gate of the transistor T2, $V_G$, causes of the drain-source voltage of the control transistor TC to decrease. Depending on the characteristics of the control transistor TC, when the drain-source voltage of this transistor is low enough, the control transistor TC switches to its region of resistive operation. The current Ipol then decreases in a regular manner until it reaches the value zero.

Lastly, FIG. 6 illustrates the variation of the value of the current $I_{T2}$ flowing through the transistor T2. As soon as the difference Vout-$V_G$ reaches the threshold voltage of the transistor T2, it no longer allows current to flow and the voltage Vout is stabilized. By way of example, the curves in FIG. 6 are obtained with a resistor R that has a value of the order of a few tens of kΩ, a capacitance Cp with a value around one pF, and a transistor TC with a width and a length of the order of ten μm each.

Figure 7:
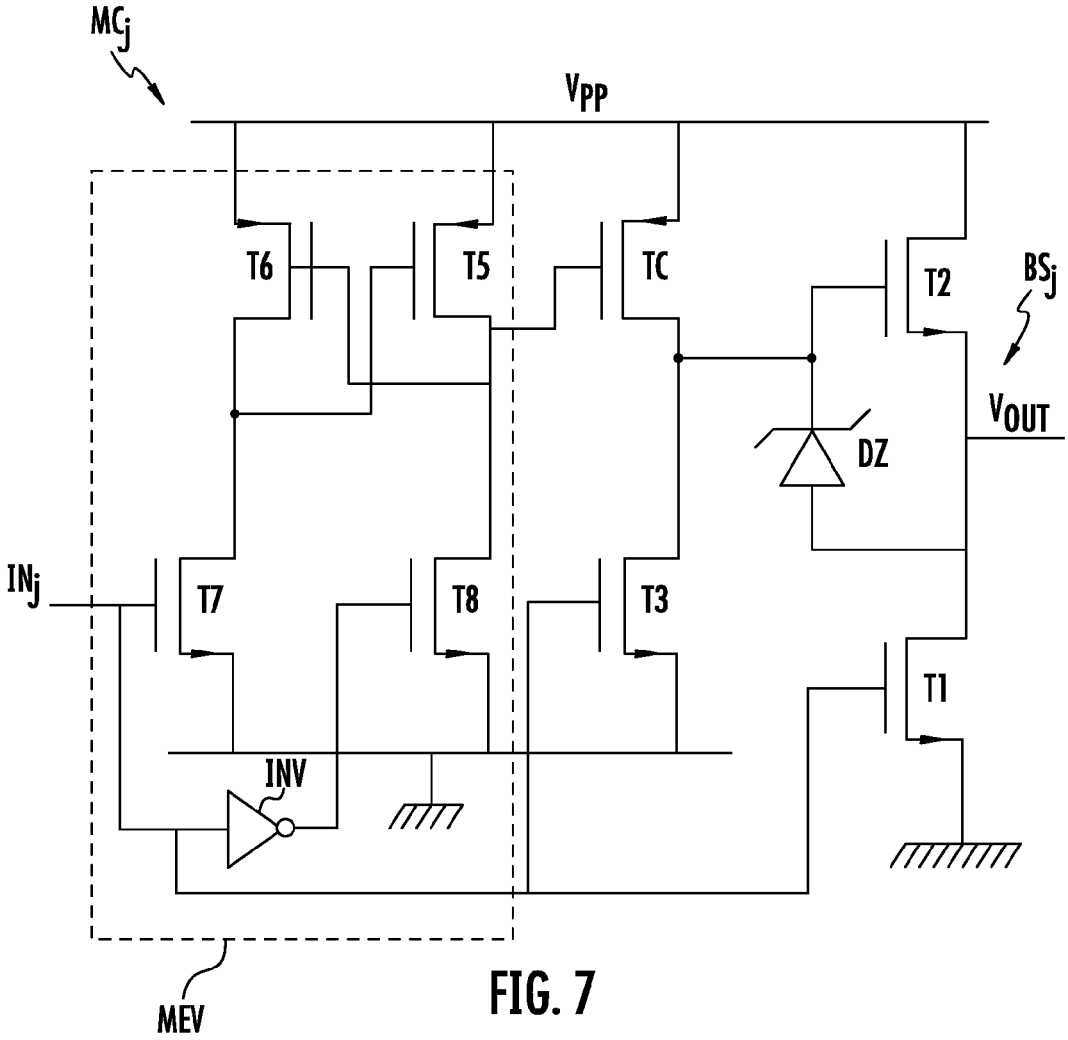
FIG. 7 illustrates in more detail an exemplary embodiment of one part of a control means according to the invention.

Reference is now made to FIG. 7, which relates to one embodiment of the means MEV forming a voltage step-up means, which is one of several possible embodiments. The means MEV comprises a first n-MOS transistor T7 receiving the signal INj on its gate and having its drain connected to ground. A transistor T8 of the n-MOS type is controlled on its gate by the inverse signal to the signal INj. An inverter INV receiving the signal INj is therefore connected upstream of the gate of T8. The drain of the transistor T8 is connected to ground.

The means MEV also comprises two other p-MOS transistors T6 and T5, whose drains are respectively connected to the drains of the transistors T7 and T8. The sources of the transistors T6 and T5 receive the voltage Vpp. The gate of the transistor T5 is connected to the drain of the transistor T7, and the gate of the transistor T6 is connected to the drain of the transistor T8.

In this example, the selection of a column implies the transition from the high state to the low state for the signal INj, so as to deliver a voltage Vout going from the low state to the high state. Conversely, a deselection implies the transition from the low state to the high state for this same signal INj.

In the case of a selection, the signal INj goes from the high state to the low state. The gates of the transistors T7, T3 and T1 are therefore at 0 volts (here the value corresponding to the low state) and they are consequently turned off. On the other hand, the gate of the transistor T8 is at 5 volts (here the value corresponding to the high state); the transistor T8 is therefore conducting. The drain of the transistor T5 is therefore at 0 volts, as is the gate of the transistor T6. The latter is conducting, which brings the gate of the transistor T5 to the value Vpp. The gate of the transistor T4 is at the value 0 volts, and it is therefore turned on due to the fact that the transistor T8 is conducting. Also, the gate of the transistor T2 of the power stage BSj is at the value Vpp and, consequently, it is turned on.

In the case of a deselection, the signal INj goes from a low value (for example 0 volts) to a high value (for example 5 volts). The gates of the transistors T1 and T3 go to 5 volts; the two transistors are therefore turned on. Consequently, the gate of the transistor T2 is at the level 0 volts, so it is turned off. Accordingly, this allows a rise time of the state change signal (here Vout) to be obtained within a given range, preferably between 70 ns and 150 ns, and this is true whatever the load connected to the circuit.

The regulation of the rise time is effected by controlling the gate of the transistor delivering the state change signal, this control being concentrated on the start of the state change. Indeed, this moment is the most critical, notably as regards the generation of voltage spikes within the control circuit. Furthermore, by limiting the control to the start of the change of state, means that are easy to implement and limited in size may be used such as a specific choice of parameters for the transistor TC and the addition of a resistor having a chosen resistance value. It goes without saying that the invention is not limited to the embodiments that have just been described, but its scope encompasses all the variants.

That which is claimed:

1. A method for controlling a matrix plasma display screen comprising rows and columns, the method comprising:

sequentially selecting the rows of the matrix plasma display screen;

emitting, for each selected row, a state change signal input to a step-up circuit to each column of a set of columns using a first transistor for allowing said each column of the set of columns to change from a first state to a second state, each state change signal comprising a transitional state from the first state to the second state;

regulating a rise time of the state change signal by limiting a current flowing through the first transistor; and controlling a control voltage delivered to a control electrode of the first transistor using a control transistor, the control transistor comprising a first electrode coupled to a power supply terminal, a second electrode for delivering the control voltage to the control electrode of the first transistor, and a control electrode directly coupled to the step-up circuit and receiving a boosted state change signal from the step-up circuit.

2. The method according to claim 1, wherein the current flowing through the first transistor is limited only during the transitional state.

3. The method according to claim 1, wherein the current flowing through the first transistor is limited when the control voltage of the first transistor is below a threshold that is a function of at least one characteristic of the control transistor.

4. The method according to claim 1, wherein the rise time of the state change signal is within an interval extending from 70 ns to 150 ns.

5. The method according to claim 1, wherein the first transistor is of MOS type.

6. A method for controlling a matrix plasma display screen comprising rows and columns, the method comprising:

sequentially selecting the rows of the matrix plasma display screen;

emitting, for each selected row, a state change signal input to a step-up circuit to each column of a set of columns using a first transistor of a MOS type for allowing each column of the set of columns to change from a first state to a second state, each state change signal comprising a transitional state from the first state to the second state;

regulating a rise time of the state change signal by limiting a current flowing through the first transistor during the transitional state; and controlling a control voltage delivered to a control electrode of the first transistor using a control transistor, the control transistor comprising a first electrode coupled to a power supply terminal, a second electrode for delivering the control voltage to the control electrode of the first transistor, and a control electrode directly coupled to the step-up circuit and receiving a boosted state change signal from the step-up circuit.

7. The method according to claim 6, wherein the current flowing through the first transistor is limited only during the transitional state.

8. The method according to claim 6, wherein the current flowing through the first transistor is limited when the control voltage of the first transistor is below a threshold that is a function of at least one characteristic of the control transistor.

9. A control device for a matrix plasma display screen comprising rows and columns, the control device comprising:

a row driver circuit configured to sequentially select the rows of the matrix plasma display screen; and a column driver circuit comprising an individual column driver unit for each column of the matrix plasma display screen, said individual column driver unit comprising a first transistor configured to emit, to each column of a set of columns, a state change signal allowing a transition of the set of columns from a first state to a second state, said first transistor configured to emit the state change signal comprising a transitional state from the first state to the second state, and a controller comprising a step-up circuit and a control transistor including a first electrode configured to be coupled to a power supply terminal, a second electrode configured to deliver a control voltage to a control electrode of said first transistor, thereby limiting a current flowing through said first transistor during the transitional state and regulating a rise time of the state change signal, and a control electrode configured to be directly coupled to said step-up circuit and to receive a boosted state change signal.

10. The control device according to claim 9, wherein the rise time of the state change signal is within an interval extending from 70 ns to 150 ns.

11. The control device according to claim 9, wherein the second electrode is configured to be coupled to the control electrode of said first transistor to deliver a control voltage having a transition from a first state to a second state with a rise time equivalent to the rise time of the state change signal.

12. The control device according to claim 9, wherein said first transistor and said control transistor are of MOS type.

13. A control device for a matrix plasma display screen, the control device comprising:

a row driver circuit; and a column driver unit comprising a step-up circuit, a first transistor configured to emit a state change signal allowing a transition of a set of columns from a first state to a second state, said first transistor configured to emit the state change signal comprising a transitional state from the first state to the second state, and a control transistor including a first electrode configured to be coupled to a reference voltage, a second electrode configured to be coupled to and deliver a control voltage to a control electrode of said first transistor, and a control electrode configured to be directly coupled to the step-up circuit and receive a boosted state change signal.

14. The control device according to claim 13, wherein the control voltage has a transition from a first state to a second state with a rise time equivalent to a rise time of the state change signal.

15. The control device according to claim 13, wherein said first transistor and said control transistor are of MOS type.

16. A display screen apparatus comprising:

a matrix plasma screen; and a drive device configured to drive for driving said matrix plasma screen comprising rows and columns, said drive device comprising a row driver circuit, and a column driver unit comprising a step-up circuit, a first transistor configured to emit a state change signal allowing a transition of a set of columns from a first state to a second state, said first transistor configured to emit the state change signal comprising a transitional state from the first state to the second state, and a control transistor including a first electrode configured to be coupled to a reference voltage, a second electrode configured to be coupled to and deliver a control voltage to a control electrode of said first transistor, and a control electrode configured to be directly coupled to the step-up circuit and receive a boosted state change signal.

17. The display screen apparatus according to claim 16, wherein the second electrode is configured to be coupled to the control electrode of said first transistor to deliver a control voltage having a transition from a first state to a second state with a rise time equivalent to the rise time of the state change signal.

18. A method for controlling a matrix plasma display screen comprising rows and columns, the method comprising:

sequentially selecting the rows of the matrix plasma display screen;

emitting, for each selected row, a state change signal input to a step-up circuit to each column of a set of columns using a first transistor of a MOS type for allowing each column of the set of columns to change from a first state to a second state, each state change signal comprising a transitional state from the first state to the second state;

regulating a rise time of the state change signal by limiting a current flowing through the first transistor during the transitional state; and controlling a control voltage delivered to a control electrode of the first transistor using a control transistor and a control resistor, the control transistor comprising a first electrode coupled to the control resistor, a second electrode coupled to the control electrode of the first transistor for delivering the control voltage, and a control electrode directly coupled to the step-up circuit and receiving a boosted state change signal from the step-up circuit.

19. The method according to claim 18, wherein the current flowing through the first transistor is limited only during the transitional state.

20. The method according to claim 18, wherein the current flowing through the first transistor is limited when the control voltage of the first transistor is below a threshold that is a function of at least one characteristic of the control transistor.

21. A control device for a matrix plasma display screen, the control device comprising:

a row driver circuit; and a column driver unit comprising a step-up circuit, a first transistor configured to emit a state change signal allowing a transition of a set of columns from a first state to a second state, said first transistor configured to emit the state change signal comprising a transitional state from the first state to the second state, a control resistor configured to be coupled to a reference voltage, and a control transistor including a first electrode configured to be coupled to said control resistor, a second electrode configured to be coupled to and deliver a control voltage to a control electrode of said first transistor, and a control electrode configured to be directly coupled to said step-up circuit and receive a boosted state change signal.

22. The control device according to claim 21, wherein the control voltage has a transition from a first state to a second state with a rise time equivalent to a rise time of the state change signal.

* * * * *